US006834510B1

(12) United States Patent
Pfister et al.

(10) Patent No.: US 6,834,510 B1
(45) Date of Patent: Dec. 28, 2004

(54) REFRIGERANT MANAGEMENT SYSTEM FOR OPTIMAL COMPRESSOR PERFORMANCE

(75) Inventors: Dennis M. Pfister, San Luis Obispo, CA (US); Charles M. Byrd, Rensselaer, NY (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 10/611,135

(22) Filed: Jun. 30, 2003

Related U.S. Application Data

(63) Continuation-in-part of application No. 10/241,199, filed on Sep. 11, 2002, now Pat. No. 6,662,591, which is a continuation of application No. 09/834,080, filed on Apr. 12, 2001, now Pat. No. 6,502,419.

(51) Int. Cl.[7] ..... F25B 45/00
(52) U.S. Cl. ..... 62/149; 62/191; 62/476
(58) Field of Search ..... 62/149, 191, 292, 62/476, 480

(56) References Cited

U.S. PATENT DOCUMENTS 5,611,211 A 3/1997 Whipple, III
5,855,119 A * 1/1999 Pfister et al. ..... 62/259.2
5,855,121 A * 1/1999 Byrd et al. ..... 62/497
6,067,807 A * 5/2000 Reimann ..... 62/141
6,502,419 B2 * 1/2003 Pfister et al. ..... 62/497
6,698,233 B2 * 3/2004 Pfister et al. ..... 62/497

* cited by examiner

*Primary Examiner*—Melvin Jones
(74) *Attorney, Agent, or Firm*—Gunnison, McKay & Hodgson, L.L.P.; Philip J. McKay

(57) ABSTRACT

A refrigerant management system provides for optimal compressor performance by providing a compressor motor designed to operate at peak efficiency under a first cooling load and at least one sensor for generating a signal that indicates the actual cooling load. A controller is provided that determines any difference between the first cooling load and the actual cooling load from the sensor signal data. The controller is coupled to a refrigerant storage device to either add or remove refrigerant to maintain the system at or near the first cooling load in accordance with the signal form the first sensor indicating the actual cooling load. Consequently, the present invention provides for automatic adjustment of the amount of refrigerant in a cooling loop system to maintain a predetermined cooling load that allows operate a compressor motor to operate at its peak efficiency.

19 Claims, 2 Drawing Sheets

REFRIGERANT MANAGEMENT SYSTEM FOR OPTIMAL COMPRESSOR PERFORMANCE

This is a continuation-in-part of U.S. patent application Ser. No. 10/241,199 filed on Sep. 11, 2002 now U.S. Pat. No. 6,662,591, which is a continuation of U.S. patent application Ser. No. 09/834,080 filed on Apr. 12, 2001, now U.S. Pat. No. 6,502,419, both of which are hereby incorporated herein by reference.

BACKGROUND OF THE INVENTION

The present invention relates to vapor compression refrigeration systems which comprise a compressor, a condenser and an evaporator that are connected in a refrigeration loop. More particularly, the invention relates to a refrigerant management system which automatically adjusts the amount of refrigerant in the refrigeration loop in order to optimize the operating efficiency of the compressor motor.

Conventional vapor compression refrigeration systems include a compressor, a condenser and an evaporator that are connected together in a closed refrigeration loop. Certain typically smaller refrigeration systems are designed to operate with a fixed amount of refrigerant, and the compressor is driven at a constant speed by an electric motor that is designed to operate at or near the peak of its efficiency curve under a predetermined cooling load. The work performed by the compressor motor is a function of the mass flow rate of the refrigerant, the heat of compression of the refrigerant in the compressor and the pressure differential across the compressor. The pressure differential across the compressor in turn is related to the cooling load, that is, the difference between the ambient temperature and a desired evaporator temperature. Thus, during assembly the refrigeration loop is charged with a specific amount of refrigerant so that the work performed by the compressor motor to achieve a predetermined amount of cooling will correspond as closely as possible to the maximum operating efficiency of the compressor motor. However, as the cooling load increases or decreases, the pressure differential across the compressor will also increase or decrease, respectively, and thereby force the compressor motor to work at less than its optimal efficiency.

One way to ensure that the compressor motor operates at its optimal efficiency is to adjust the amount of refrigerant in the refrigeration loop in conjunction with the changing cooling loads. This will vary the mass flow rate of the refrigerant and therefore allow the compressor motor to continue to work at or near its optimal efficiency. Certain prior art devices have been developed to increase or decrease the amount of refrigerant in the refrigeration loop for this purpose. For example, U.S. Pat. No. 5,611,211 discloses a device which comprises a refrigerant storage vessel that is connected to the refrigeration loop and a thermal input element that can selectively heat the refrigerant in the storage vessel to expand and thereby displace the refrigerant into the refrigeration loop. However, the response times of such devices tend to be relatively slow, and the introduction of heat into the refrigeration system may be less than desirable.

SUMMARY OF THE INVENTION

In accordance with the present invention, these and other disadvantages in the prior art are overcome by providing a refrigerant management system for a vapor compression refrigeration system which comprises a compressor, a condenser and an evaporator that are connected together in a refrigeration loop through which a refrigerant is conveyed. The compressor is driven by a motor which operates at or near the peak of its efficiency curve under a first cooling load. The refrigerant management system comprises at least one sensor for generating a signal which is indicative of an actual cooling load on the refrigeration system, a controller for determining a difference between the actual cooling load and the first cooling load from the sensor signal, and a refrigerant storage device which is responsive to the controller to either remove refrigerant from or add refrigerant to the refrigeration loop.

The refrigerant storage device comprises a housing which defines an enclosure that is connected to the refrigeration loop and which includes first and second electrical conductors, a valve which is selectively activated by the controller to control the flow of refrigerant between the refrigerant loop and the enclosure, a sorbent which is positioned in the enclosure between the first and second conductors, and a power supply which is connected to the conductors and which is selectively activated by the controller. When the valve is open and the power supply is deactivated, the refrigerant will be drawn from the refrigeration loop and combine with the sorbent to form a refrigerant/sorbent compound. Furthermore, when the valve is open and the power supply is activated, the power supply will generate a current through the refrigerant/sorbent compound to desorb the refrigerant from the sorbent, whereupon the refrigerant will expand into the refrigeration loop. In this manner, when the controller detects the difference between the actual cooling load and the first cooling load, the controller will activate the refrigerant storage device to adjust the amount of refrigerant in the refrigeration loop to maintain the compressor motor operating at or near the peak of its efficiency curve.

Thus, the present invention provides a means to automatically adjust the amount of refrigerant in the refrigeration loop in conjunction with the changing cooling loads to ensure that the compressor motor will work at or near its optimal efficiency. In addition, the refrigerant storage device relies on proven adsorption and desorption processes to effect the adjustment of the refrigerant in the refrigeration loop. Moreover, since the desorption reaction is driven by an electric current, the refrigerant storage device does not rely on heat to displace the refrigerant into the refrigeration loop.

These and other objects and advantages of the present invention will be made apparent from the following detailed description, with reference to the accompanying drawings. In the drawings, the same reference numbers are used to denote similar elements in the various embodiments.

DETAILED DESCRIPTION OF THE PREFERRED EMBODIMENTS

Figure 1:
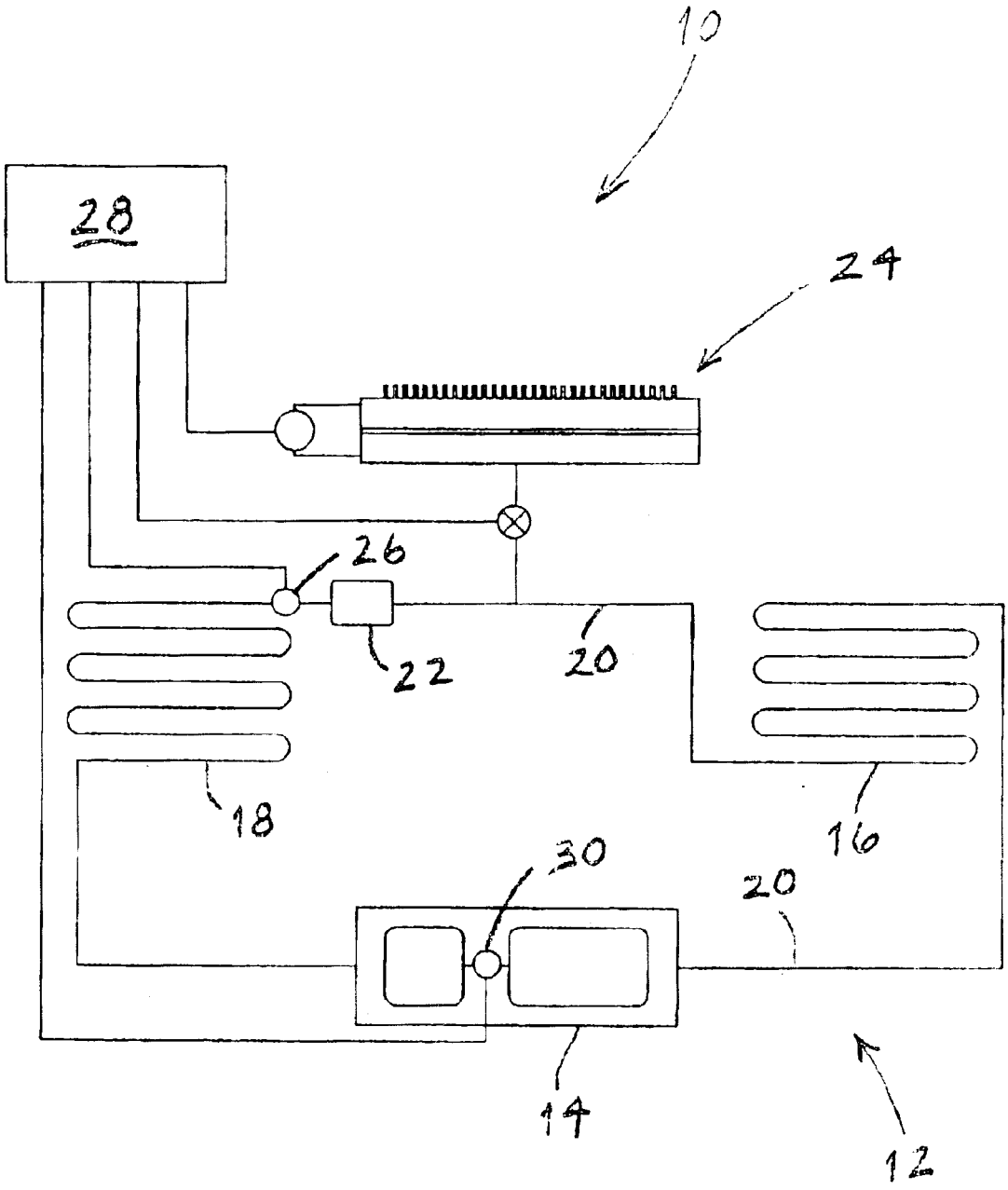
FIG. 1 is a diagrammatic representation of the refrigerant management system of the present invention shown installed on an exemplary vapor compression refrigeration system.

Referring to FIG. 1, the refrigerant management system of the present invention, which is indicated generally by reference number 10, is shown installed on an exemplary vapor compression refrigeration system 12. While the refrigerant management system 10 is suitable for use with practically any vapor compression refrigeration system, for purposes of the present description only the common features of a typical vapor compression refrigeration system will be discussed. Accordingly, the vapor compression refrigeration system 12 is shown to comprise a compressor 14, a condenser 16 and an evaporator 18 which are connected together in a refrigeration loop 20 through which a suitable refrigerant is conveyed. The compressor 14 is driven by a motor M which is connected to a suitable power supply (not shown). As is well understood by those of ordinary skill in the art, the compressor 14 compresses the refrigerant into a high pressure, high temperature liquid which is then conveyed through the refrigeration loop 20 to the condenser 16. The liquid refrigerant is allowed to cool to ambient temperature in the condenser 16 before being conveyed to an expansion device 22, such as an expansion valve or a capillary tube, which is mounted immediately upstream of the evaporator 18. After passing through the expansion device 22, the refrigerant will evaporate in the evaporator 18 and in the process absorb heat from the surrounding environment to produce a cooling effect.

The compressor motor M is typically designed to operate at the peak of its efficiency curve under a predetermined cooling load, which will be referred to herein as the optimal cooling load. This point of optimal efficiency is ordinarily the rated maximum power output level of the compressor motor. Thus, the compressor motor M will perform an optimal amount of work to produce a quantity of cooling which is required to meet the optimal cooling load. This optimal amount of work will sometimes be referred to herein as the optimal work output of the compressor motor M. The work performed by the compressor motor M is a function of the mass flow rate of the refrigerant, the heat of compression of the refrigerant in the compressor 14 and the pressure differential of the refrigerant across the compressor, which is directly related to the cooling load on the refrigeration system 12. The cooling load on the refrigeration system is in turn related to the difference between the ambient temperature and a desired evaporator temperature, which is typically preset by the operator of the refrigeration system through a conventional operator set point circuit (not shown).

As is typical with smaller vapor compression refrigeration systems, the compressor 14 has a fixed volume and the compressor motor M is driven at a constant speed. Consequently, the mass flow rate of the refrigerant will depend only on the amount of refrigerant in the refrigeration loop 20. Thus, in order to enable the compressor motor M to operate at the peak of its efficiency curve under the optimal cooling load, the refrigeration loop 20 is charged with an initial amount of refrigerant which will provide the required refrigerant mass flow rate. However, if the cooling load changes, the amount of work performed by the compressor motor M will also change, and the compressor motor M will no longer operate at the peak of its efficiency curve.

In accordance with the present invention, the refrigerant management system 10 automatically adjusts the amount of refrigerant in the refrigeration loop 20 as the cooling load on the refrigeration system 12 changes so that the compressor motor M will continue to operate at or near the peak of its efficiency curve. Accordingly, the refrigerant management system 10 preferably comprises a refrigerant storage device 24 which is connected to the refrigeration loop 20, preferably between the condenser 16 and the evaporator 18, at least one sensor 26 for detecting a condition corresponding to the cooling load on the refrigeration system 12, and a controller 28 for selectively activating the refrigerant storage device 24 to either add refrigerant to or withdraw refrigerant from the refrigeration loop in response to a change in the cooling load. In addition, the refrigerant management system 10 ideally also includes a suitable filter (not shown), which may be positioned between the refrigeration loop 20 and the refrigerant storage device 24 to prevent any oil that is contained in the refrigerant from entering the refrigerant storage device.

The controller 28 is preferably a programmable controller which is capable of automatically activating the refrigerant storage device 24 in response to preprogrammed instructions stored in an associated memory device. The various functions of the controller 28 will be made apparent hereafter. The sensor 26 may be any suitable transducer which is capable of generating a signal that is indicative of the cooling load on the refrigeration system 12. For example, the sensor 26 may be a temperature sensor, such as a thermocouple, which is ideally located upstream of the evaporator 18 so as to detect the temperature of the refrigerant immediately prior to entering the evaporator, which under normal circumstances should correspond to the ambient temperature. The controller 28 will periodically sample the temperature from the sensor 26 and determine the desired cooling load based on the difference between this temperature and a desired evaporator temperature. The controller 28 will then compare the desired cooling load to the optimal cooling load to determine if a change in the cooling load has occurred.

If a change in the cooling load on the refrigeration system 12 has occurred, the controller 28 will activate the refrigerant storage device 24 to either add refrigerant to or withdraw refrigerant from the refrigeration loop 20 to ensure that the compressor motor M continues to operate at or near the peak of its efficiency curve. In this regard, an algorithm corresponding to the relationship between the work performed by the compressor motor and the mass flow rate of the refrigerant, the desired cooling load and the heat of compression of the refrigerant in the compressor is preferably stored in the associated memory device of the controller 28. Using the previously determined or stored values for the amount and direction of the change in the cooling load (or alternatively the value of the desired cooling load), the heat of compression of the refrigerant in the compressor, the optimal work output of the compressor motor M, the density of the refrigerant, and the volume and speed of the compressor 14, the controller 28 will calculate an amount of refrigerant which must be added to or removed from the refrigeration loop 20 to maintain the compressor motor M operating at or near the peak of its efficiency curve.

The controller 28 will then activate the refrigerant storage device 24 to adjust the amount of refrigerant in the refrigeration loop 20 accordingly. As will be discussed more fully below, in one embodiment of the invention the controller 28 will calculate the length of time that the refrigerant storage device 24 should be activated in order to add or remove the required amount of refrigerant to or from the refrigeration loop 20. However, the refrigerant management system 10 may also include a second sensor 30 for generating a signal which is directly indicative of the work performed by the compressor motor M, such as a motor power, motor torque or motor phase angle sensor. Thus, once the controller 28 determines the amount and direction of the change in the cooling load on the refrigeration system 12, the controller will activate the refrigerant storage device 24 to add refrigerant to or remove refrigerant from the refrigeration loop 20 until the sensor 30 indicates that the compressor motor M is again operating at or near the peak of its efficiency curve.

In accordance with the present invention, the refrigerant storage device 24 relies on the principles of chemical adsorption and desorption to adjust the amount of refrigerant in the refrigeration loop 20. In chemical adsorption systems, a first, typically gaseous substance called a sorbate is alternately adsorbed onto and desorbed from a second, typically solid substance called a sorbent. During the adsorption reaction, the relatively low pressure sorbate is drawn onto and combines with the sorbent to produce a sorbate/sorbent compound. During the desorption reaction, energy is supplied to the sorbate/sorbent compound to break the bonds between the sorbate and sorbent molecules and thereby desorb the sorbate from the sorbent. In this reaction, the sorbate molecules are driven off of the sorbent molecules and into a relatively high pressure, high energy gaseous state.

In the refrigerant management system 10, the sorbate is a refrigerant, such as the same refrigerant which is contained in the refrigeration loop 20. In addition, the refrigerant storage device 24 preferably utilizes an electrical current to desorb the refrigerant from the refrigerant/sorbent compound. Furthermore, although not required for purposes of the present invention, the refrigerant and the sorbent are specifically selected so that the current will not appreciably heat the refrigerant/sorbent compound during the desorption reaction. Consequently, the desorption of the refrigerant from the refrigerant/sorbent compound is substantially non-thermal.

Figure 2:
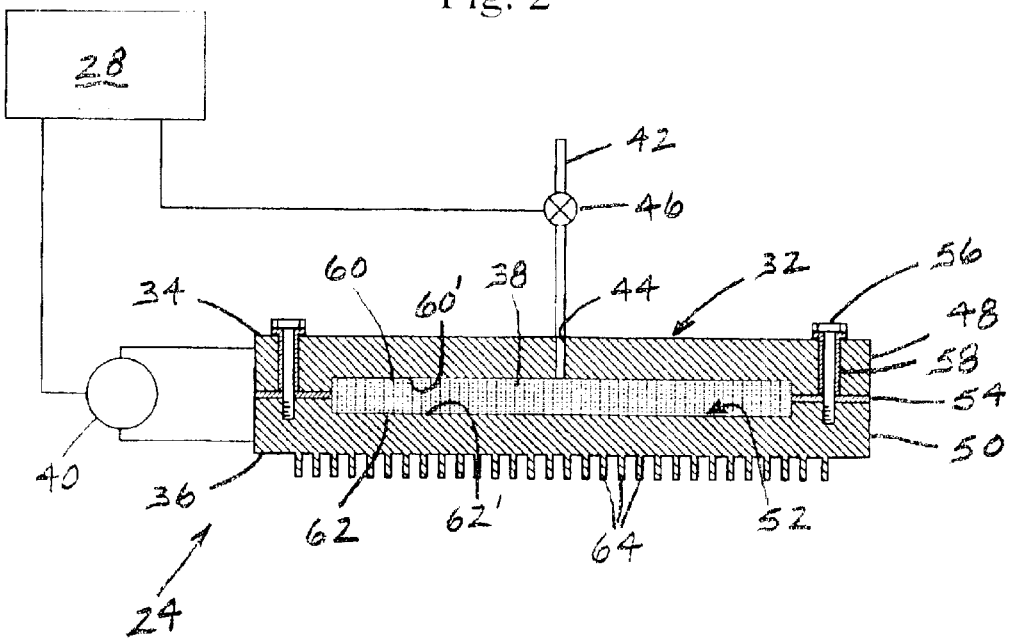
FIG. 2 is a diagrammatic, partial cross-sectional representation of the refrigerant management system shown in FIG. 1.

Referring to FIG. 2, the refrigerant storage device 24 is shown to comprise a housing 32 which includes spaced apart first and second conductors 34, 36, a refrigerant/sorbent compound 38 which is contained within the housing 32 between the first and second conductors, and a power supply 40 which is connected to both the controller 28 and the first and second conductors. The refrigerant/sorbent compound 38 is placed in fluid communication with the refrigeration system 12 via a conduit 42 which is connected between the refrigeration loop 20 and an inlet/outlet port 44 in the housing 32. If necessary, a valve 46 may be provided in the conduit 42 to control the flow of refrigerant into and out of the housing 32. To facilitate the automatic operation of the refrigerant management system 10, the valve 46 is preferably an electrically actuated solenoid-type valve which is controlled by the controller 28.

In operation of the refrigerant management system 10, when the controller 28 determines that refrigerant should be added to the refrigeration loop 20, the controller will open the valve 46 and activate the power supply 40, which will generate a preferably DC current through the first and second conductors 34, 36 and across the refrigerant/sorbent compound 38 to desorb the refrigerant from the refrigerant/sorbent compound. As the refrigerant molecules are desorbed from the refrigerant, the resulting high pressure refrigerant will expand through the inlet/outlet port 44 and the conduit 42 and into the refrigeration loop 20. Once the desorption reaction is complete, the controller will close the valve 46 and deactivate the power supply 40.

The amount of power and the approximate length of time required to complete the desorption reaction are dependent on the amounts and types of refrigerant and sorbent materials present in the refrigeration storage device 24 and the amount of refrigerant that is required to be added to the refrigeration loop 20. For example, if a cooling load requires that $X_{refrigerant}$ grams of refrigerant be added to the cooling loop 20 and it is known that $E_{desorb}$ joules of energy are required to desorb one gram of refrigerant from the sorbent, then a total of $E_{desorb}$ joules/gram times $X_{refrigerant}$ grams= $E_{total}$ joules of energy will be required to desorb the refrigerant from the sorbent. The total desorption time, $t_{desorb}$, is obtained by dividing $E_{total}$ by the applied power level $P_{supply}$ from the power supply 40.

When the controller 28 determines that refrigerant should be removed from the refrigeration loop 20, the controller will open the valve 46 to expose the refrigerant in the refrigeration loop 20 to the sorbent in the housing 32. Due to the affinity between the selected refrigerant and sorbent molecules, the refrigerant molecules in the refrigeration loop 20 will be drawn into the housing 32 and adsorbed onto the sorbent. The time required to complete the adsorption reaction depends on the amount of refrigerant that must be removed from the cooling loop 20 and can be determined in a manner similar to that discussed above for the adsorption reaction. Once the required amount of refrigerant is withdrawn from the refrigeration loop 20, the valve 46 is again closed to prevent the further removal of refrigerant from the refrigeration loop.

A particularly advantageous feature of the present invention is the ability of the refrigerant storage device 24 to desorb various amounts of refrigerant from the refrigerant/sorbent compound 38. Such a partial desorptions can be achieved by applying the electrical current to the refrigerant/sorbent compound for varying amounts of time. Since upon activation of the power supply 40 the electrical current will immediately begin desorbing the refrigerant molecules from the sorbent molecules, a proportionately larger amount of refrigerant is separated from the sorbent as the desorption reaction progresses. As discussed above, the time required to desorb a given amount of refrigerant with a particular power source can be readily determined. Thus, if one desires to desorb only a percentage of the available refrigerant, then the current is applied for approximately the same percentage of time. Another portion of refrigerant may be desorbed subsequently.

It should be noted that, depending on the sorbent material selected for the sorption compression system 10, a valve 46 may not be necessary to control the flow of refrigerant into the housing 32. As will be discussed below, certain sorbent materials, such as organometallic materials, are poor electrical conductors in the absence of a refrigerant. Thus, once the refrigerant has been completely desorbed from the sorbent, the current will not resistively heat the sorbent. However, the small current flux through the sorbent will prohibit the refrigerant molecules from re-adsorbing on the sorbent. Therefore, the power supply 40 can be activated to initiate the desorption reaction, and can be left on until an adsorption reaction is required, whereupon the power supply is deactivated to allow the refrigerant to adsorb onto the sorbent.

Figure 3:
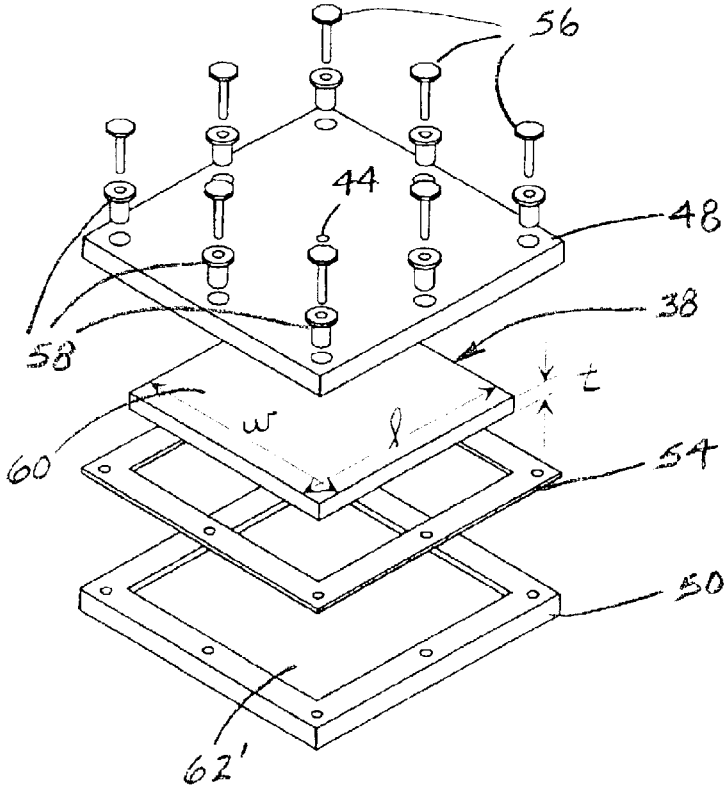
FIG. 3 is an exploded view of the refrigerant storage component of the refrigerant management system shown in FIG. 2.

Since the housing 32 is the enclosure within which the desorption and adsorption reactions take place, the housing must function to contain the refrigerant/sorbent compound 38, conduct the current from the power supply 40 to the refrigerant/sorbent compound, and provide for communication of the refrigerant to and from the sorbent. Numerous devices having various structural and electrical configurations may be conceived to perform these functions. By way of example, the housing 32 depicted in FIGS. 2 and 3 is shown to comprise a recessed top plate 48 which is attached to a recessed bottom plate 50 to form an enclosure 52 for the refrigerant/sorbent compound 38. In this embodiment of the housing 32, the top plate 48 forms the first conductor 34 and the bottom plate 50 forms the second conductor 36. Accordingly, the top and bottom plates 48, 50 are made of a suitable electrically conductive material, such as an Aluminum alloy. In addition, a gasket 54 made of an appropriate electrically insulating, chemically inert and heat resistant material, for example synthetic rubber, is positioned between the top and bottom plates 48, 58 to provide both electrical insulation and a pressure-tight seal between the top and bottom plates. Furthermore, the top and bottom plates 48, 50 are secured together with a number of suitable fasteners 56, such as high strength steel bolts. An insulating grommet 58 which is made of a suitable electrically insulating and heat resistant material, such as Teflon®, is positioned between each bolt 56 and the top plate 48 to electrically insulate the bolt, and thus the bottom plate 50, from the top plate.

The housing 30 preferably also functions to help dissipate the heat of adsorption from the refrigerant/sorbent compound 38. During the desorption reaction, the kinetic energy of the refrigerant molecules is converted to heat as the refrigerant molecules combine with the sorbent molecules. This heat, which is referred to as the heat of adsorption, must be dissipated prior to the next adsorption reaction so that the sorbent can re-adsorb the refrigerant. Thus, in addition to being electrically conductive, the top and bottom plates 48, 50 are preferably constructed of a material having a good thermal conductivity. Also, if as shown in FIGS. 2 and 3 the sorbent comprises relatively large top and bottom surfaces 60 and 62 compared to its thickness "t", the top and bottom plates 48, 50 preferably each include a respective inner surface 60', 62' which engages substantially the entire corresponding top or bottom surface 60, 62. In this manner, the thermal diffusion path length for the refrigerant/sorbent compound 38 will be minimized (in effect one-half the thickness "t"), and the rate of heat transfer from the refrigerant/sorbent compound will consequently be maximized. Furthermore, the top plate 48 or the bottom plate 50, or both, may be provided with cooling fins 64 to assist in the dissipation of the heat of adsorption from the refrigerant/sorbent compound 38.

The transfer of thermal and electrical energy through the junction between the sorbent and the housing 32 is preferably optimized by enhancing the contact between the sorbent and the top and bottom plates 48, 50. Depending on the type of sorbent employed in the refrigerant storage device 24, this may be accomplished by soldering or brazing the sorbent to the top and/or bottom plates 48, 50. Alternatively, the sorbent may be affixed to the top and/or bottom plates 48, 50 using a suitable thermally and electrically conductive adhesive. Where brazing, soldering or gluing are not appropriate, the sorbent and the housing 32 may be designed with a slight interference fit to produce a suitable contact pressure between the sorbent and the top and bottom plates 48, 50. The contact between the sorbent and the housing 32 may also be enhanced by positioning a foil of soft metal, such as indium, between the sorbent and each of the top and bottom plates 48, 50.

The selection of the particular refrigerant and sorbent materials for the refrigerant management system 10 depends in large part on the desired nature of the desorption reactions undertaken in the refrigerant storage device 24. A desired, though not necessary, feature of the invention is that, when the electrical current is conducted through the refrigerant/sorbent compound to effect the desorption reaction, the refrigerant/sorbent compound is not heated appreciably. Thus, the desorption reaction is substantially non-thermal. In the context of the present invention, "non-thermal desorption" refers to a mechanism of desorption that does not rely on thermal energy to stochastically heat the refrigerant/sorbent compound to the degree sufficient to break the bonds between the refrigerant and sorbent molecules. Thus, while some isolated, localized heating of the refrigerant/sorbent compound may occur during the desorption reaction, the temperature of the refrigerant/sorbent compound should remain statistically below the threshold temperature for thermal desorption to take place.

One method for determining whether a particular desorption reaction is either thermal or substantially non-thermal is to measure the bulk temperature of the refrigerant/sorbent compound during the desorption cycle. If the bulk temperature of the compound during desorption is greater than the known temperature which is required to effect a thermal or heat-activated desorption, then the reaction is thermal. However, if the bulk temperature of the refrigerant/sorbent compound during the desorption reaction is less than the temperature required to effect the thermal desorption, the reaction may or may not be thermal.

In this event, the velocity distribution of the desorbed refrigerant molecules may be analyzed to determine whether the desorption reaction is substantially non-thermal. The molecular velocity distribution can be determined by, for example, using time-of-flight spectroscopy to produce a time-resolved distribution of the florescence intensities of a characteristic molecular beam. Then, using a Fourier transform, the molecular velocity distribution can be extracted from the florescence data. Since it is known that in a non-thermal process the velocity distribution of the desorbed refrigerant molecules should be primarily non-Maxwellian, by analyzing the time-of-flight spectroscopy data, the thermal/non-thermal nature of the desorption process can be determined.

The exact mechanism by which the electrical current effects the desorption of the refrigerant molecules from the sorbent molecules varies depending on the type of sorbent employed. Moreover, while the exact mechanism is not known, the inventors believe that, when the current is conducted through the refrigerant/sorbent compound, electrons are channeled into each refrigerant-sorbent bond until the bond is broken and the refrigerant molecule is liberated from the sorbent molecule. With respect to the carbon-based sorbents which will be discussed below, one theory is that the electrons from the power supply displace the electrons of the refrigerant molecule in the conduction band of the sorbent molecule, thereby freeing the refrigerant molecule from the sorbent molecule. Another theory is that the electrons impart sufficient energy to the refrigerant molecule to allow it to escape the electrical potential binding it to its associated sorbent molecule.

In addition to the nature of the desorption reaction, the selection of the refrigerant and sorbent materials depends on the requirements of the refrigeration system 12 and the refrigerant storage device 24. For example, the refrigeration system 12 may need to provide a specific amount of cooling, which may require the use of certain refrigerants. In addition, it may be desirable to minimize the response time of the refrigerant storage device 24 in order to maximize the efficient operation of the compressor motor M. The response time is dependent on the time required to adsorb or desorb a desired amount of refrigerant, which in turn depends on the particular refrigerant and sorbent materials employed in the system.

The refrigerant and sorbent materials are preferably also selected based on the desired electrical and thermal conductivities of these materials. Since the desorption reaction is driven by an electric current, the refrigerant/sorbent compound should be a good electrical conductor. In addition, in the event that the refrigerant molecules bind only to the surface of the sorbent material during the adsorption reaction, the sorbent should also be a good electrical conductor. Moreover, if the power supply 40 is an AC power supply, the refrigerant and sorbent materials should ideally be selected so that the combined impedance of the housing 32 and the refrigerant/sorbent compound 38 matches that of the power supply to ensure that the maximum amount of power is transferred from the power supply to the refrigerant/sorbent compound. If on the other hand the power supply 40 is a DC power supply, the refrigerant and sorbent materials should optimally be selected so that the combined resistance of the housing 32 and the refrigerant/sorbent compound 38 is sufficiently large to avoid overloading the power supply.

Furthermore, because the heat of adsorption must be dissipated from the refrigerant/sorbent compound and the sorbent prior to a subsequent adsorption reaction, both the refrigerant/sorbent compound 38 and the sorbent should be good thermal conductors. In a preferred embodiment of the invention, the sorbent comprises a thermal conductivity at least as great as that of aluminum or copper. It has been found that using a sorbent with such a thermal conductivity and a refrigerant that meets the other requirements of the refrigerant storage device 24 and the refrigeration system 12 will result in a refrigerant/sorbent compound that has a sufficient thermal conductivity for purposes of the present invention.

The sorbent should also comprise certain physical properties to enable it to be effectively utilized in the refrigerant storage device 24. For example, the sorbent is preferably sufficiently strong to withstand repeated adsorption and desorption reactions without fracturing or decomposing. In addition, the sorbent is ideally comprised of a material that can be soldered or brazed to the housing 32 to enhance the transfer of thermal and electrical energy through the junction. between the sorbent and the housing. Furthermore, the sorbent is optimally configured or constructed to comprise suitable mass transfer paths to facilitate the passage of a maximum amount of refrigerant through the sorbent in a minimum amount of time during the adsorption and desorption reactions. Also, since the total amount of refrigerant that can be adsorbed on a sorbent is proportional to the total surface area of the sorbent, the sorbent preferably comprises a relatively large surface area per unit volume of material.

Consistent with the above discussion, some preferred sorbent materials for use in the present invention include pitch-based carbon and graphitic foams, examples of which are disclosed in U.S. Pat. Nos. 5,961,814 and 6,033,506, which are hereby incorporated herein by reference. In order to improve the adsorption capacity of these foams, they may be activated using any suitable activation technique. Another suitable sorbent material for use in the present invention is applicants' proprietary pre-activated graphitic foam product, which is described in applicants' co-pending U.S. patent application Ser. No. 10/174,838, which is hereby incorporated herein by reference. Simple carbon and graphite pellets, granules, powders and fibers may also be used as the sorbent material in the present invention. These materials are preferably activated using a suitable activation method in order to improve their adsorption capacity. Also, any of the sorbent materials disclosed in applicants' U.S. patent application Ser. No. 09/834,080 may be used as the sorbent in the present invention. It should be understood that this list of possible sorbent materials is not complete, and that other materials which meet some or all of the above-listed requirements may also be suitable sorbents. The present invention should therefore not be limited by the particular sorbent materials listed above.

Other sorbent materials which are suitable for use in the present invention are the organometallic composite semiconductors. Organometallic materials are electrically insulating and must be doped in order to conduct electricity. According to the present invention, therefore, the organometallic sorbent material can be doped with the refrigerant. This doping is typically accomplished through a redox reaction in which the refrigerant acts as either an electron acceptor or donor. The dopant anions can be driven out of the sorbent by providing a cathodic or anodic pulse of current through the refrigerant/sorbent compound. Once the refrigerant is desorbed from the sorbent, the sorbent will no longer conduct electricity. An example of this type of sorbent is a composite material having nanographitic clusters of a metallo-phthaloxyanine based sorbent supported by, for example, a high surface area graphite or zeolite structure.

In the embodiment of the invention shown in the Figures, the sorbent is formed into a monolithic member having a thickness "t" and generally parallel top and bottom surfaces 60, 62 which each have a length "l" and a width "w". Although the surfaces 60, 62 are depicted as rectangular, they could have any practical shape. Since in this embodiment the top and bottom plates 48, 50 of the housing 32 function to both conduct the electrical current across and dissipate the heat of adsorption from the refrigerant/sorbent compound 38, the electrical conduction and thermal diffusion paths are both aligned in the direction of the thickness "t" of the sorbent. As mentioned above, in order to maximize the amount of power which is transferred to the refrigerant/sorbent compound from an AC power supply, the combined impedance of the housing 32 and the refrigerant/sorbent compound 38 should match that of the power supply. Thus, for given refrigerant and sorbent materials, the thickness "t" of the sorbent may be increased or decreased to adjust the impedance accordingly.

However, in order to minimize the thermal diffusion path length, the thickness "t" of the sorbent should be kept as small as possible. In the event the heat of adsorption is dissipated through both the top and bottom surfaces 60, 62, the thickness "t" is preferably less than the smallest linear dimension of the top or bottom surface, which, for example, is the length of the minor side of a rectangle, the length of any side of a square, or the length of the diameter of a circle. If the heat of adsorption is dissipated through only one of the top and bottom surfaces 60, 62, the thickness "t" is preferably less than one-half the smallest linear dimension of the top or bottom surface. More preferably, the thickness "t" is less than one-tenth the smallest linear dimension of the top or bottom surface. By sizing the sorbent accordingly, the minimum thermal diffusion path length will be transverse to the top and bottom surfaces, and the heat of adsorption will consequently be readily dissipated through either or both of these surfaces.

The refrigerant which is used in the refrigerant storage device 24 is preferably the same refrigerant that is employed in the vapor compression refrigeration system 12. Therefore, the choice of the refrigerant will usually be dictated by the manufacturer of the refrigeration system 12. However, the inventors have discovered that many common refrigerants may be readily used with the carbon and graphitic foam sorbents discussed above, including R134, Ammonia and Carbon Dioxide, among others. These refrigerants are readily desorbed by an electrical current and form refrigerant/sorbent compounds that will not heat appreciably during the desorption reaction.

Prior to operation of the refrigerant management system 10, the refrigerant storage device 24 is "charged" with a sufficient amount of refrigerant to handle the largest anticipated increase in the cooling load on the refrigeration system 12. The refrigerant storage device 24 is charged by adsorbing the refrigerant onto the sorbent during the construction of the refrigerant management system 10. Thus, the refrigerant storage device 24 initially contains an amount of refrigerant which when added to the refrigeration loop 20 will enable the compressor motor M to operate at or near the peak of its efficiency curve under the most sever cooling load anticipated for the refrigeration system 12. However, the refrigerant storage device 24 is initially not fully charged. Rather, the refrigerant/sorbent compound 38 will have sufficient excess adsorption capacity to allow the refrigerant storage device 24 to withdraw an adequate amount of refrigerant from the refrigeration loop 20 to enable the compressor motor M to continue to operate at or near the peak of its efficiency curve under the lightest anticipated cooling load.

The refrigerant storage device 24 is preferably charged with refrigerant in the following manner. Referring again to FIG. 2, a predetermined amount of sorbent is sealed within the enclosure 52 of the housing 32 and the inlet/outlet port 44 is connected to a vacuum source (not shown). With a vacuum applied to the enclosure 52, an electrical current is conducted through the sorbent to drive off any water molecules or other contaminants that may be present in the sorbent. During this preparation step, the current may result in the sorbent being resistively heated, depending on the amount of contaminants that are present in the sorbent and the type of sorbent that is used. If so, then it is desired that the sorbent be heated to about 200° C. to ensure that the contaminants are sufficiently separated from the sorbent. This step is desirable to ensure that no contaminants are present that may interfere with the adsorption of the refrigerant onto the sorbent or result in the refrigerant/sorbent compound being resistively heated by the current during operation of the refrigerant storage device 24. After the contaminants are separated from the sorbent, they are drawn out of the housing 32 by the vacuum. With the vacuum source removed, but with vacuum pressure maintained within the enclosure 52, the housing is allowed to cool to ambient temperature, after which a predetermined amount of refrigerant is introduced into the enclosure, for example via the inlet/outlet port 44, and allowed to adsorb onto the sorbent. At this point, the sorbent is charged with the refrigerant and the refrigerant storage device 24 is ready for operation.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. In combination with a vapor compression refrigeration system which comprises a compressor, a condenser and an evaporator that are connected together in a refrigeration loop through which a refrigerant is conveyed, the compressor being driven by a motor which operates at or near the peak of its efficiency curve under a first cooling load, a refrigerant management system comprising:

at least one first sensor for generating a signal which is indicative of an actual cooling load on the refrigeration system;

a controller for determining a difference between the actual cooling load and the first cooling load from the first sensor signal; and a refrigerant storage device comprising:

a housing which defines an enclosure that is connected to the refrigeration loop and which includes first and second electrical conductors;

a valve which is selectively activated by the controller to control the flow of refrigerant between the refrigeration loop and the enclosure;

a sorbent which is positioned in the enclosure between the first and second conductors; and a power supply which is connected to the conductors and which is selectively activated by the controller;

wherein when the valve is open and the power supply is deactivated, the refrigerant will be drawn from the refrigeration loop and combine with the sorbent in an adsorption reaction to form a refrigerant/sorbent compound; and wherein when the valve is open and the power supply is activated, the power supply will generate a current through the refrigerant/sorbent compound to desorb the refrigerant from the sorbent in a desorption reaction, whereupon the refrigerant will expand into the refrigeration loop;

wherein when the controller detects the difference between the actual cooling load and the first cooling load, the controller will activate the refrigerant storage device to adjust the amount of refrigerant in the refrigeration loop to maintain the motor operating at or near the peak of its efficiency curve.

2. The vapor compression refrigeration system of claim 1, wherein the desorption reaction is substantially non-thermal.

3. The vapor compression refrigeration system of claim 1, wherein:

the housing comprises an electrically conductive first member, an electrically conductive second member which is connected to the first member, and an electrical insulator which is positioned between the first and second members; and the first and second conductors comprise the first and second members, respectively.

4. The vapor compression refrigeration system of claim 3, wherein:

the sorbent comprises first and second generally parallel surfaces and a thickness which is transverse to the first and second surfaces; and the thickness is less than one-half the smallest linear dimension of the first and second surfaces.

5. The vapor compression refrigeration system of claim 4, wherein the adsorption reaction produces a heat of adsorption which is conducted through the sorbent and the first and second members.

6. The vapor compression refrigeration system of claim 3, wherein the sorbent is attached to one or both of the first and second members.

7. The vapor compression refrigeration system of claim 1, wherein the power supply is an AC power supply and the refrigerant/sorbent compound comprises an impedance which is approximately the same as the impedance of the power supply.

8. The vapor compression refrigeration system of claim 1, wherein the sorbent comprises a carbon foam material.

9. The vapor compression refrigeration system of claim 1, wherein the sorbent comprises a graphitic foam material.

10. The vapor compression refrigeration system of claim 1, wherein the refrigerant storage device further comprises at least one second sensor for generating a signal indicative of an amount of work performed by the motor, and wherein the controller will deactivate the power supply and close the valve when the amount of work is approximately the same as an amount of work performed by the motor when the motor is operating at or near the peak of its efficiency curve.

11. In combination with a vapor compression refrigeration system which comprises a compressor, a condenser and an evaporator that are connected together in a refrigeration loop through which a refrigerant is conveyed, the compressor being driven by a motor which operates at or near the peak of its efficiency curve under a first cooling load, a refrigerant management system comprising:

a sensor for generating a signal which is indicative of an actual cooling load on the refrigeration system;

a controller for determining a difference between the actual cooling load and the first cooling load from a sensor signal; and a refrigerant storage device which comprises:

first and second electrical conductors;

a sorbent that is positioned between the first and second conductors and which is capable of combining with the refrigerant in an adsorption reaction to form a refrigerant/sorbent compound; and a power supply which is connected to the first and second conductors and which is selectively activated by the controller to desorb the refrigerant from the refrigerant/sorbent compound in a desorption reaction;

wherein when the controller detects the difference between the actual cooling load and the first cooling load, the controller will initiate an adsorption reaction or a desorption reaction in the refrigerant storage device to thereby adjust the amount of refrigerant in the refrigeration loop to maintain the motor operating at or near the peak of its efficiency curve;

wherein the desorption reaction is substantially non-thermal.

12. The vapor compression refrigeration system of claim 11, wherein the sorbent comprises a thickness which is transverse to the first and second surfaces and which is less than one-half a smallest linear dimension of the surfaces.

13. The vapor compression refrigeration system of claim 12, wherein the thickness is less than one-tenth the smallest linear dimension of the surfaces.

14. The vapor compression refrigeration system of claim 11, wherein the refrigerant/sorbent compound comprises an impedance which is approximately the same as the impedance of the power supply.

15. The vapor compression refrigeration system of claim 11, wherein the sorbent comprises a carbon foam material.

16. The vapor compression refrigeration system of claim 11, wherein the sorbent comprises a graphitic foam material.

17. A method for adjusting the amount of refrigerant in a vapor compression refrigeration system which comprises a compressor, a condenser and an evaporator that are connected together in a refrigeration loop through which the refrigerant is conveyed, the method comprising:

determining a first cooling load on the refrigeration system;

comparing the first cooling load with a predetermined second cooling load which corresponds to an optimal operating condition of the refrigeration system;

adjusting the amount of refrigerant in the refrigeration loop in response to a difference between the first and second cooling loads to maintain the optimal operating condition of the refrigeration system;

wherein the adjusting step comprises one of the following steps:

adsorbing the refrigerant onto a sorbent in an adsorption reaction to form a refrigerant/sorbent compound, whereupon the refrigerant will be drawn out of the refrigeration loop; and desorbing the refrigerant from the sorbent in a desorption reaction, whereupon the refrigerant will expand into the refrigeration loop.

18. The method of claim 17, wherein the desorption reaction is substantially non-thermal.

19. The method of claim 17, further comprising:

determining an operating condition of the refrigeration system which corresponds to the optimal operating condition; and terminating the adjusting step when the operating condition is approximately the same as the optimal operation condition.

* * * * *